United States Patent [19]

Riedel et al.

[11] 3,969,797

[45] July 20, 1976

[54] APPARATUS FOR REGULATING THE SHEARING OF PILE FABRIC

[75] Inventors: Dieter Riedel; Horst Rathert, both of Minden; Gerhard Grannemann, Friedewalde, all of Germany

[73] Assignee: Drabert Sohne, Minden, Westphalia, Germany

[22] Filed: Apr. 4, 1973

[21] Appl. No.: 347,713

Related U.S. Application Data

[63] Continuation-in-part of Ser. No. 120,545, March 3, 1971, abandoned.

[52] U.S. Cl. ..... 26/15 R; 26/17

[51] Int. Cl.[2] ..... D06C 13/00; D06C 13/02

[58] Field of Search ..... 26/15 R, 17

[56] References Cited

UNITED STATES PATENTS

| | | | |
|---|---|---|---|
| 2,695,438 | 11/1954 | Bejeuhr | 26/17 |
| 3,099,871 | 8/1963 | Dourdeville | 26/17 |
| 3,683,468 | 8/1972 | Kaufman | 26/15 R |

FOREIGN PATENTS OR APPLICATIONS

| | | | |
|---|---|---|---|
| 1,183,741 | 3/1970 | United Kingdom | 26/17 |

*Primary Examiner*—Robert R. Mackey

*Attorney, Agent, or Firm*—Mason, Mason & Albright

[57] ABSTRACT

A machine for shearing the pile of napped cloth includes a shearing bar and a shearing blade spaced by a variable gap from the bar. A control arrangement in accordance with the invention includes a sensing device for sensing the thickness of the base portion of the material and a further sensing device for measuring the variable gap. Signals from both sensing devices are compared and the output difference, if any, is used to actuate controls which adjust the variable gap.

8 Claims, 10 Drawing Figures

INVENTORS
DIETER RIEDEL, HORST RATHERT,
GERHARD GRANNEMANN.
BY
Mason, Mason & Albright
ATTORNEYS

Δδ AS THE REGULATING MAGNITUDE FOR THE AUTOMATIC ADJUSTMENT OF DEPTH OF SHEAR

INVENTORS
DIETER RIEDEL, HORST RATHERT,
GERHARD GRANNEMANN,
BY
Mason, Mason & Albright
ATTORNEYS INVENTORS
DIETER RIEDEL, HORST RATHERT,
GERHARD GRANNEMANN.
BY
Mason, Mason & Albright
ATTORNEYS INVENTORS
DIETER RIEDEL, HORST RATHERT,
GERHARD GRANNEMANN.
BY
Mason, Mason & Albright
ATTORNEYS INVENTORS
DIETER RIEDEL, HORST RATHERT,
GERHARD GRANNEMANN.
BY
Mason, Mason & Albright
ATTORNEYS

APPARATUS FOR REGULATING THE SHEARING OF PILE FABRIC

CROSS REFERENCE TO RELATED APPLICATION

This application is a continuation-in-part based on copending application in the name of Dieter Riedel et al., Ser. No. 120,545 filed Mar. 3, 1971, now abandoned.

BACKGROUND OF THE INVENTION

1. Field of the Invention

This invention relates to a device with which a constant shearing effect can be obtained during the continuous shearing of the pile of lengths of material of varying thickness.

2. Description of the Prior Art

To achieve a smooth surface or a more or less pronounced pile, material such as velvet, plush and the like, is shorn with machines consisting basically of a rotary cutter arrangement operating in conjunction with a fixed bottom blade and a table on which the material is fed forward. To set the depth of shear, that is to say the actual gap between top cutter, bottom blade and table, use is generally made of gauges introduced between the table and the bottom cutter or between the material and the bottom cutter.

The machine operator judges the degree of density by the effort required to move these gauges and raises or lowers the cutter until he considers it is in the right position. To enable goods in the form of runs to be shorn economically, a number of such runs are sewn together and fed continuously through the machine. However, when several runs of material of one and the same quality are to be shorn, it is seldom found that the individual pieces are of uniform thickness.

Even with goods of the same kind, thickness variation mostly arises in the gauging equipment, as a result of variations in batch washing or of fulling.

Should the operator fail to regulate the gap between the table and cutter, the pile will vary in depth. A conscientious worker will adjust the depth of shear by gauge for every run, which naturally wastes a lot of time.

Moreover, uniform treatment of the various pieces of material depends on the skill of the operator, who can always make errors of judgment. Devices have already been proposed, by means of which the thickness of the first piece of material can be ascertained between the bottom blade and a sensing device associated with an indicator gauge fitted to the table. Then, with the aid of the same gauge, the bottom blade is adjusted in the same conditions until the gauge reading for the next piece of material again corresponds to the measurement indicated for the first piece.

This adjustment has to be made manually and the drive of the shearing machine must be stopped or disconnected during adjustment and re-setting, so that the output of the entire installation is reduced accordingly.

U.S. Pat. Ser. No. 3,683,468 discloses a shearing apparatus with two cutters which are movable towards and away from one another. A device is disclosed for measuring the value of the shear gap during relative motion of the shearing members.

When a voltage source is switched on, the voltage is applied directly across the cutters and the measuring device indicates the current flow set up. Since the electrical resistance between the cutters is directly dependent upon the value of the air gap between the two shearing members, an exact measurement of the cutter gap can be provided by the measuring device. With this device a measurement of the width of the shearing member gap is possible, on the basis of which further devices for the adjustment of the shears or of the shear table can be brought into action when the apparatus is in operation. A similar apparatus is also disclosed in French Pat. Spec. No. 1,422,111, but neither discloses any means which simultaneously take into account and control operation of the apparatus in dependence upon both the thickness of the material and the gap between the shearing members at any given instant.

An object of the present invention is to eliminate, at least partially, the drawbacks and disadvantages of existing adjustment devices. During normal shearing, that is to say without interruption of work, the thickness of the runs of material to be shorn can first be measured and then, in the event of a sudden variation in thickness, the gap between the shearing bar or table and the shearing blade can be appropriately reset automatically to defined limits, without the need for any manual intervention in the setting or re-setting of the depth of shear. Such automatic adjustment or correction of the depth of shear can be carried out, if need be, during the shearing of any particular piece of material. Mostly, however, sudden variations in thickness occur before and after the join between two pieces of unequal thickness that have been sewn together. Since, owing to the substantial thickening of the material at the seam, the gap between the cutter and the shearing bar must be enlarged in any case, to allow passage of the seam, the invention provides for the setting or re-setting of the original depth of shear, according to the thickness variation before and after the seam, to be determined and carried out during the said period, while the seam is passing through. Enlargement of the gap as the seam passes through can be achieved by conventional means by the sudden raising of the cutter arrangement as a whole from the shearing bar or by suddenly lowering or swinging the shearing bar away from the cutter arrangement. Once the seam has been passed, the shearing gap automatically re-set in accordance with the invention comes into play, with its corresponding new depth of shear.

SUMMARY OF THE INVENTION

According to the invention there is provided in a control arrangement incorporated in a shearing machine for shearing material having a base layer and a nap, means for sensing continuously the thickness of the base layer and generating a signal having a value dependent upon that thickness, a measured value recorder for measuring the actual size of the shearing gap of the machine and for generating a signal having a value dependent upon that gap, regulating means connected to receive both said signals and to generate a difference signal, and a re-set device connected to receive said difference signal and to vary the shearing gap of the machine until the difference signal reaches zero magnitude.

In addition to electrical transmission of measurement values, it is also possible to use pneumatic systems introducing pneumatic power-comparison methods based on the nozzle and impact-plate system, electro-pneumatic power-comparison methods with an electrical input and electrical-to-pneumatic signal conversion or displacement-path measurement converters. In the case of the latter system with "displacement-path" comparison, a pneumatic compensation gauge is used, which follows the needle deflections of a dial indicator, for example, at a constant distance (pneumatic follower system).

The values derived from the means for sensing the thickness of the base layer and from the measured value recorder at the shearing gap are fed to the regulating means in which they are compared with each other.

Any deviation between the two measurement values acts through the regulating means to set in operation a re-setting device for varying the shearing gap. This re-setting action continues until the algebraic difference ($U_1 - U_2$) between the values fed into the regulating means, representing thickness and gap, is equal to nil or the magnitudes fed into the regulating means are equal to each other with positive or negative sign ( $/U_1/ - /U_2/ = 0$ ).

In other words, the regulator operates the gap resetting device until the measurement value $U_2$ of the gap is equal to the input voltage $U_1$ of the thickness measuring device, i.e., $U_1 = U_2$, or $/U_1/ = /U_2/$.

The re-setting device, according to the invention, displaces a stop serving as a final limit for the shearing gap.

For example, when the thickness in the vicinity of the seam joining two pieces of material is being measured and a sudden change is recorded, the new measured value will be passed to the regulating means for evaluation, not at once, but only after a given time delay.

The delay between the determination of a new material thickness and the corresponding re-setting of the shearing gap can be brought about, for example, by digital measurement and hence independently of speed.

Thus, if a thickening of the run of material should be simulated on the thickness measuring device by the passage of a knot on the face of the material, the old value will be re-measured directly after the knot has passed and over-regulation of the whole system will be avoided with the aid of the digital delay.

If two measuring devices be fitted a given distance apart so as to take measurements at right angles to the run of the material, measurement signals can be passed to the regulating means only if both the measuring devices record the same thickness variation in the material.

When a seam arrives in the vicinity of the thickness measuring device, for example, this is what happens;

Just before the approach of the greatly thickened seam, the thickness $\delta_1$ of the first piece of material gives a measured voltage of $U_1$. The seam itself produces an enormous change in the measuring device, the measured voltage values soaring above a particular limit and thereby starting, with the aid of a digital counter, for example, a delay that is independent of speed. During that delay, new measurement values along a path, namely those of the material in the following piece, of thickness $\delta_2$, are converted into a measurement voltage $U_2$. During this delay, the sensors of the thickness measuring device should be damped, so that, at the expiration of the delay governed by the path, a true measurement value $U_2$ may be fed to the regulating means for evaluation.

BRIEF DESCRIPTION OF THE DRAWINGS

Certain embodiments of the invention will now be described, by way of example, with reference to the accompanying diagrammatic drawings, in which.

DESCRIPTION OF THE PREFERRED EMBODIMENTS

Figure 1:
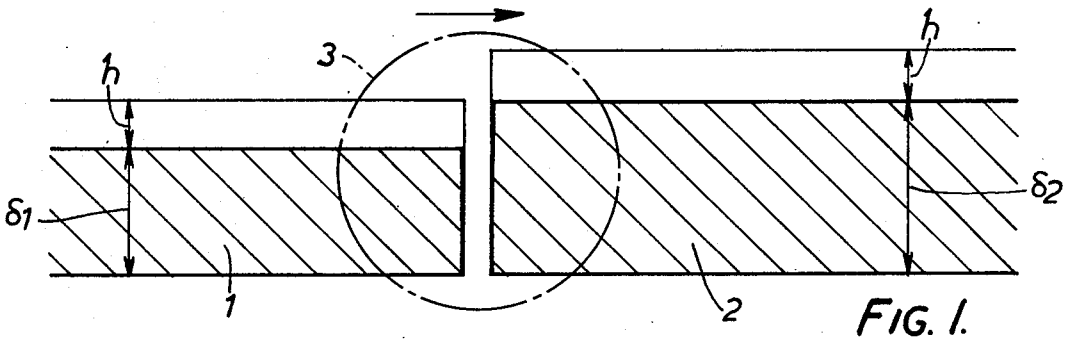
FIG. 1 is a section, to an enlarged scale, of material to be sheared showing a portion where two pieces of material are joined together by a seam.

In FIG. 1, the thickness of a piece of material 1 is designated $\delta_1$ while that of a piece 2 is designated $\delta_2$. A seam 3 joins the two pieces of material 1 and 2 together. The pile covering the face of the material is indicated by the depth of pile $h$, the value of which is to be maintained constant irrespective of the difference between the thicknesses $\delta_1$ and $\delta_2$ of the two joined pieces.

Figure 2:
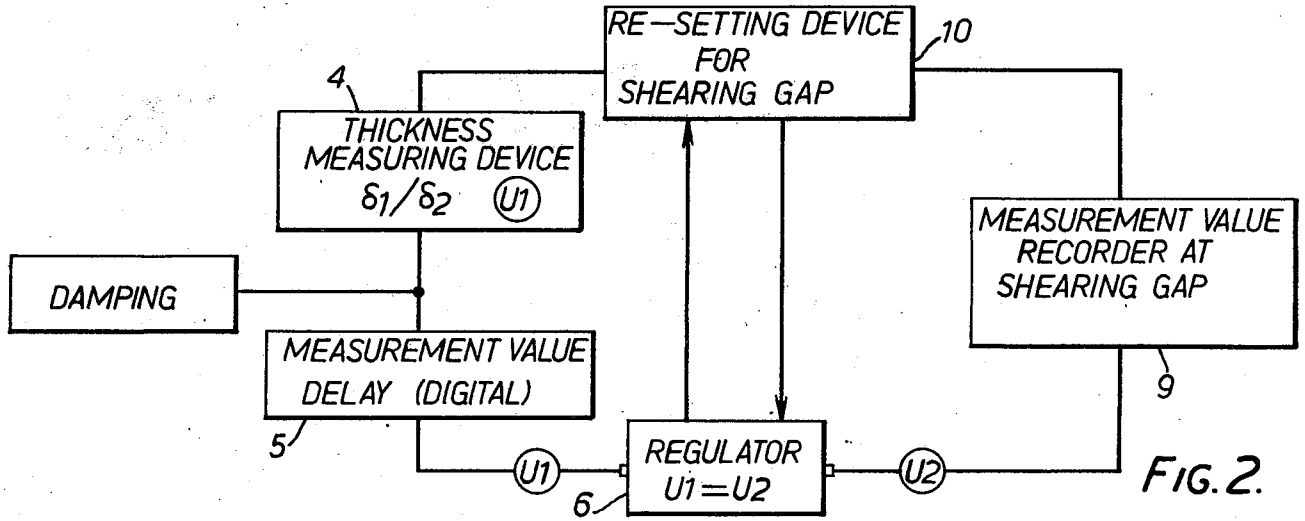
FIG. 2 is a block diagram, common to all the individual embodiments, of a control circuit of apparatus in accordance with the invention.

FIG. 2 illustrates a block diagram of a control circuit for automatic re-setting of the shearing gap to accommodate variations in thickness of the material.

Figure 5:
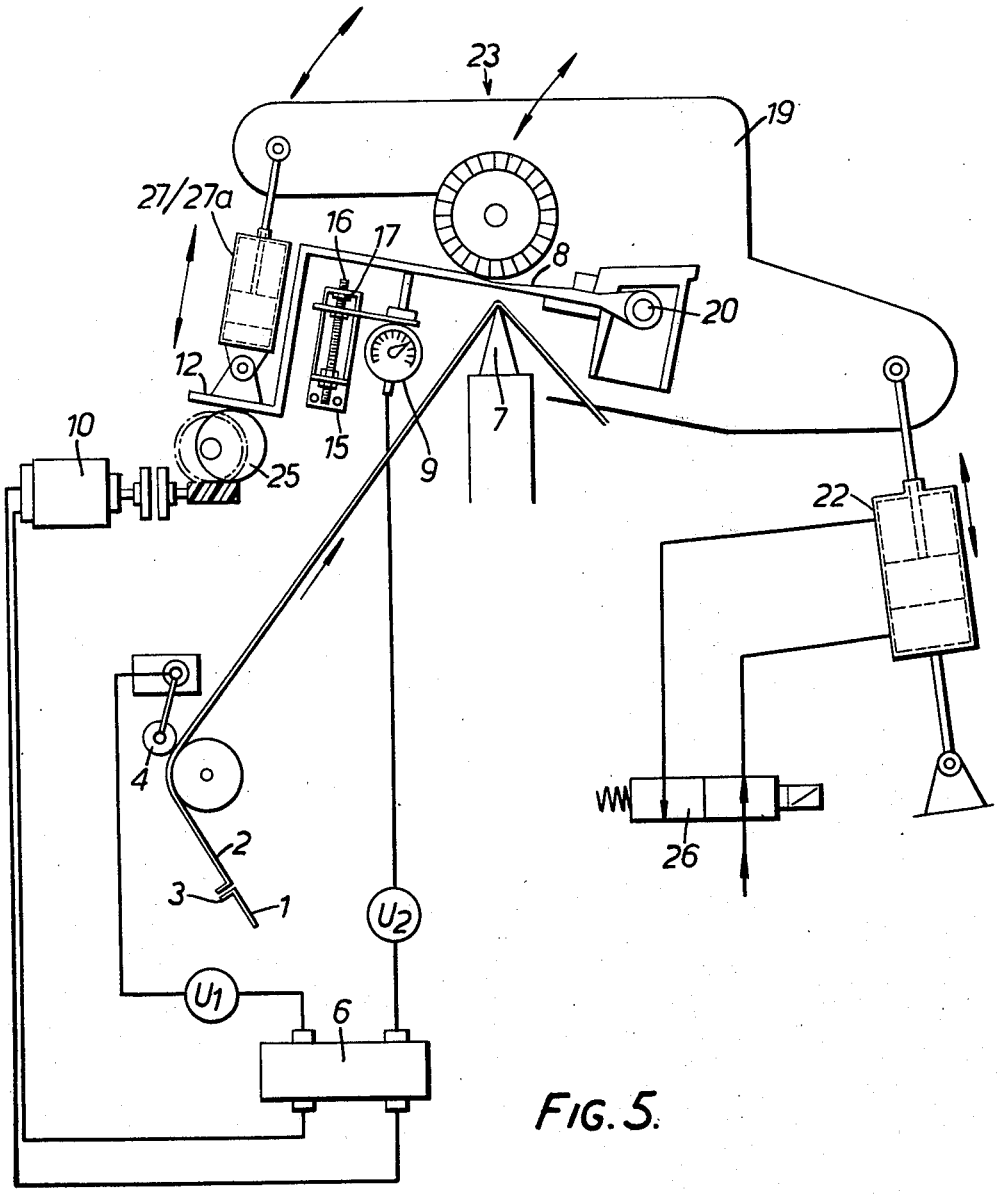
FIG. 5 shows an embodiment of an automatic control arrangement for the shearing gap including electro-pneumatic and electro-mechanical means, the cutter arrangement being raised from the fixed shearing bar to afford free passage to the seam.

A thickness measuring device 4 has the form of a sensor (details shown in FIGS. 5A and 5C) for the runs of material 1 and 2 that are to be shorn, the value of the measured thickness $\delta_1$ being converted into an electrical or pneumatic magnitude and after, for example, a delay by a digital delay unit 5, being fed to an electronic or pneumatic regulator 6, for evaluation. The sensing device measures both gradual and sudden thickness changes. A measured value recorder 9 (see also FIG. 5A) of an inductive, electronic or pneumatic nature, serves to convert the actual size of the shearing gap into an electrical or pneumatic magnitude, and is fitted directly or indirectly at the gap between the bar or table 7 and the shearing blade 8. The thickness values measured by the sensor 4 and by the measurement value recorder 9 at the gap are fed to the regulator 6 (for details see FIG. 5A) and compared with each other. Any difference between the two measurement magnitudes acts through the regulator 6 to operate a gap re-setting device 10, until the difference between the values fed to the regulator 6 becomes zero.

The re-setting device 10 serves to move stops 11 (FIG. 4), 12 (FIG. 5) and 13 (FIG. 7), which serve to provide a final absolute limit for the gap.

Figure 3:
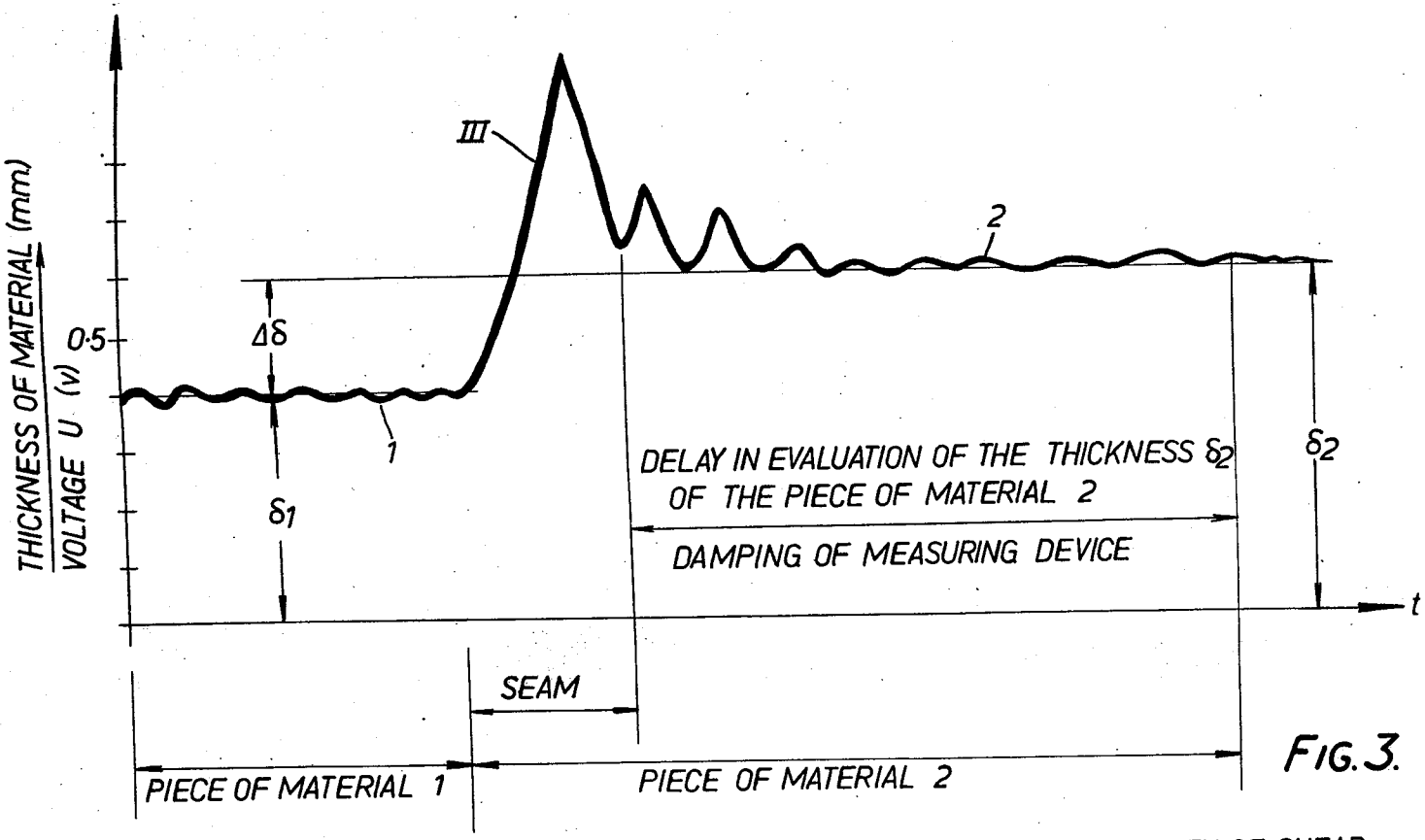
FIG. 3 is a graph illustrating an evaluation of the measurement results in the vicinity of the joining seam of FIG. 1.

FIG. 3 shows the sequence of events when, with the aid of the sensor 4, used for measuring the thickness in the vicinity of the seam 3, an abrupt change is recorded. The peak measurement value III is not evaluated; instead, and only after a predetermined delay produced by the delay unit 5, a fresh measurement value $\delta_2$, is signalled to the regulator 6 for evaluation. The delay between the thickening of the material at the seam 3 and the re-setting of the shearing gap governed by the change $\Delta\ \delta$ in the thickness of the material may be applied digitally, for example, and hence independently of speed.

During this period, the thickness-measuring sensor 4 is damped.

The thickness measuring sensor 4 (FIG. 5C) performs two functions. It serves, on the one hand, for the continuous measurement of the effective thickness of the material, and, on the other hand, is used for detecting the thickened seam 3. Thus the sensor 4 is also operative to bring a digital counting device 40 into operation. The transfer of the thickness of the material from a roller **4*b* of the thickness-measuring sensor to a scanning pin 4*a* is transmitted directly proportionally through a bellcrank lever 45 (FIG. 5C) which is subject to a damping force. A finely adjustable torsion spring 44 is intended to prevent oscillation about the roller 4*b* of the pin 4*a*. In the thickness measuring sensor shown in detail in FIG. 5C, the thickness of the material is transmitted by the roller 4*b* to the bellcrank lever 45 and thence to an inductive position transducer 4*c***.

The necessary pressure of the roller on the material is controlled by the finely adjustable torsion spring 44, which is mounted upon the pivot of the lever 45.

The position transducer 4C has a stroke of 2 millimeters. With a material thickness, delta equal to 0, it is completely retracted, but with increasing thickness of the material the pin **4*a* is extended, until with material 2 millimeters thick it is completely relieved of pressure. Thickening in the material, for example seams, cannot damage the sensor by use of this construction because the spring 44 ensures low inertia of the lever 45 so that a sudden increase in thickness caused by a seam will merely deflect the sensor and hence a setscrew 47 thereof away from the transducer pin 4*a*. The pin 4*a* is attached to the housing by means of a clamp 41 and the setscrew 47 serves for the basic adjustment of the sensor and for altering the measuring range. By adjusting this setscrew 47** the measuring range can be adjusted at will.

If the screw is screwed out by 1 millimeter, the measuring range will be 1 – 3 millimeters instead of up to 2.0 millimeters.

Figure 4:
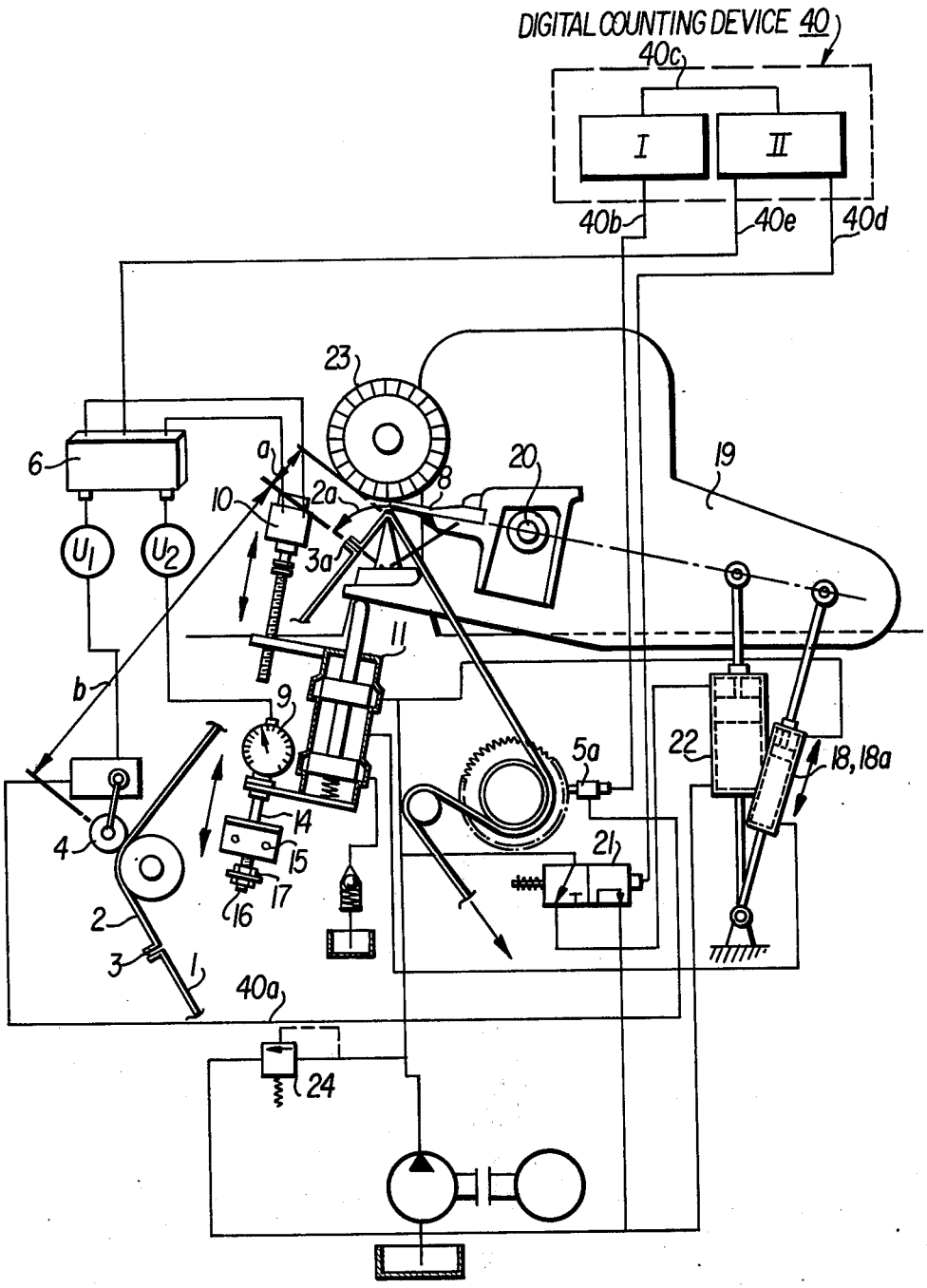
FIG. 4 shows an embodiment of an automatic control arrangement for the shearing gap including electro-hydraulic means, the cutter arrangement being raised from the fixed shearing bar or table to afford free passage to the seam.

In the embodiment shown in FIG. 4, the re-setting device 10 is responsible for the automatic displacement of a stop 11, in the form of a hydraulic edge follower, which hydraulically sets a final limit to the gap between the shearing bar 7 and the shearing blade 8. The sensor 4 is essentially the same as in the embodiments of FIGS. 5, 5A and 5B.

When the thickness of the material changes, the deviation in measurement magnitude fed into the regulator 6 results in the displacement of the stop 11, being maintained until the measurement values $U_2$ and $U_1$ entering the regulator are equal to each other.

Figure 5A:
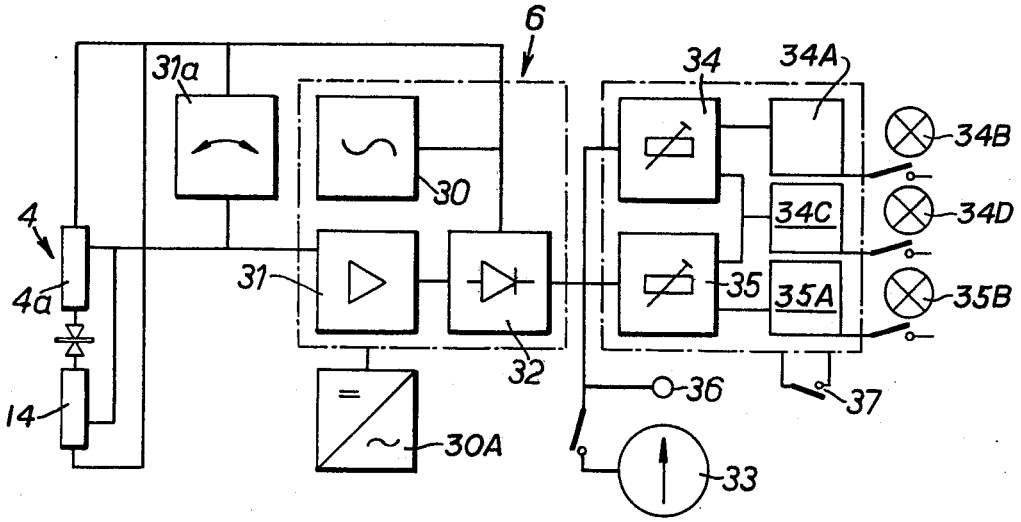
FIG. 5A is an electrical circuit diagram showing details of some of the components of FIGS. 4 and 5.
Figure 5C:
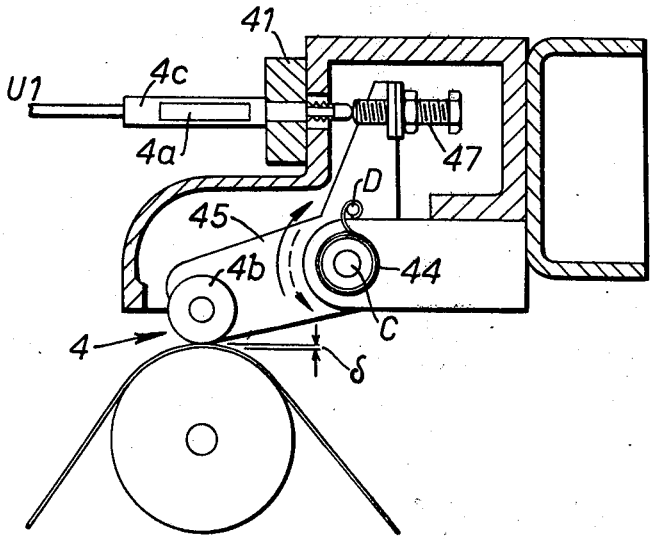
FIG. 5C is a section illustrating a thickness measuring device as incorporated in the embodiments of FIG. 4, FIG. 5, FIG. 6 and FIG. 7.

The regulator 6 incorporates well known components and is shown in detail in FIG. 5A. The induction measuring sensor 4 operates on the principle of a differential transformer. The primary winding of the transformer is excited by a generator 30 incorporated in the regulator 6 and receiving current from a source 30A and supplying an exactly constant alternating voltage. A soft magnetic core is associated with each of two sensing pins **4*a*, 14 or other sensing devices and couples the primary winding of the transformer without physical contact and free from reaction with two secondary windings of the transformer, which are arranged on either side of the primary winding and connected in opposition. The output voltage of the secondary windings is zero when the core is in its central position. Under other conditions, it corresponds in amplitude and phase to the size and direction of the core shift and therefore of the deflection of the sensing pin 4*a*, 14.**

A measuring amplifier 31, also forming part of the regulator, sums the signal voltages which are derived from the two measuring sensor devices **4*a* and 14 and a fine adjuster 31*a*** and also from external, rated-value, transmitters, and amplifies the sum which corresponds to the adjusted measuring range.

The amplified alternating measuring voltage is converted in a phase-sensitive rectifier 32, into a direct voltage, which is proportional in value and sign to the deflection of the sensing pin **4*a* and hence of the roller 46 or pin 14 of measured value recorder 9. This voltage, indicated on a moving coil instrument 33, is passed to electronic limit switches 34 and 35 and is available for rapid processing of the measurement at an analog output 36 at which acoustic or optical signals can be provided. The limit switches 34 and 35 control contactless electronic relays 37, which activate the hydraulic mechanism 18, 18*a* and 22 for raising and lowering the shearing mechanism 23.** At the same time, a given voltage is assigned to each thickness of the material *a*. If, for example, the thickness of the material is equal to 0.5 millimeters, this corresponds to a voltage of 20 volts. A thickness of material of 0.6 millimeters would correspond to a voltage of for example 25 volts.

The limit switch 34 is connected to a relay 34A which, in turn, supplies a lamp 34B which is illuminated when the shearing gap is greater than the thickness of the material. Both limit switches 34 and 35 are connected to a second relay 34C and this in turn supplies a lamp 34D which is illuminated whenever adjustment of the gap is taking place. The limit switch 35 is connected to a third relay 35A which is, in turn, connected to a lamp 35B which is illuminated when the shearing gap is too small.

The sensor device or measured value recorder 9 covers the range of the shear gap. The shear gap is the distance between the tip of the shearing bar or table 7 and the lower edge, that is the one opposite to it, of the blade 8. If the shear gap is for example 0.5 millimeters, this corresponds to a voltage of about 20 volts.

The re-setting device 10 thus energized by the regulator 6 displaces not only the stop 11, but also the measurement value recorder 9 by which the displacement value is converted into an electrical or pneumatic magnitude. The measurement value recorder 9 includes a feeler or sensor pin 14 on the hydraulic stop 11 and this bears against stop bracket 15, the basic setting of which, for equalization purposes, can be sensitively carried out and limited by a setting spindle 16 with a locknut 17.

The hydraulic stop 11 is in direct operative connection with a left-hand and a right-hand setting cylinder 18 and 18*a* respectively, through a lever 19, having its fulcrum at 20.

If, for example, owing to a change in thickness in the material being shorn, the hydraulic stop 11 is displaced, the setting cylinders 18 and 18*a* connected to it produce a new shearing gap. The two cylinders 18, 18*a* constitute, in principle only a single piston. The illustration is intended to indicate only that the piston is fitted with a damper. The manner of operation is such that the hydraulic stop 11 in the form of a two edged sensor similar to the system of a hydraulic copier control is in direct connection with the two cylinders 22 or 18, 18*a*.

An absolute limit is set to the gap variation by the lever 19 coming up against the stop 11.

Figure 5B:
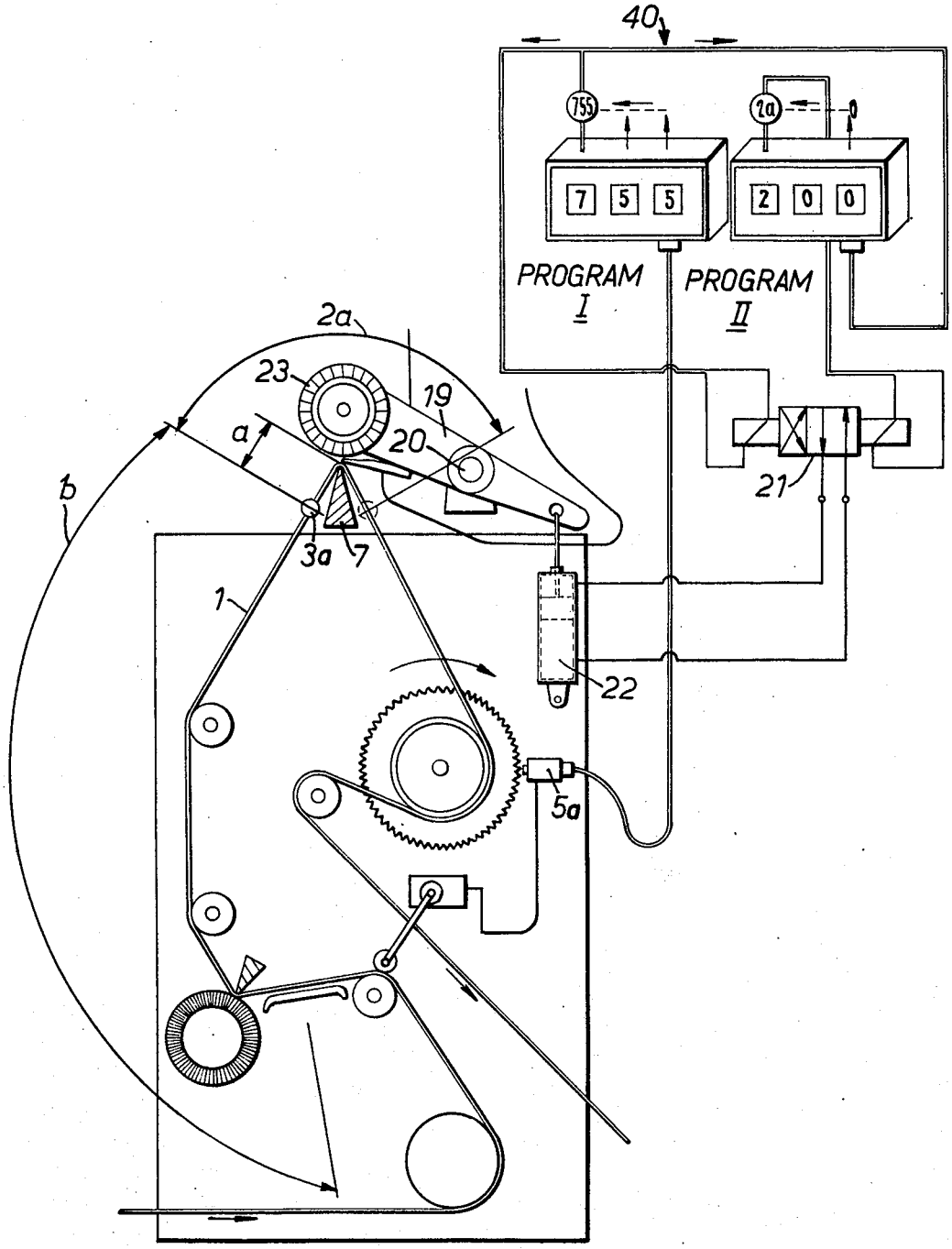
FIG. 5B is a diagram of a system similar to that of FIGS. 4 and 5, but showing certain control features in greater detail.

The distance between the point of sensing of the seam by the device 4 and the shearing bar 7 is measured with the aid of a digital counting device 40, which is indicated in FIGS. 4 and 5B. The distance *a* from device 4 tp seam 3*a* (location where cutter 23 is disengaged from the material) is then fixed and programmed so that an electronic output signal has to be supplied for raising the cutter 23 and therefore pivoting it about the fulcrum 20. This output signal is derived from the digital counting device 40 (FIGS. 4 and 5B) and passes via a control valve 21 to the hydraulic setting cylinder 22, which acts on the lever 19.

The digital counting device 40 has two programs, of which program I counts the arcuate value *b* and program II the distance 2*a*, that is twice the distance from the cutter to the position at which the cutter is disengaged from the material. During the period of raising and lowering of the cutter 23, that is during the time of passage through of the seam 3, the automatic change in the shear gap takes place. This is effected as follows: As soon as program I (corresponding to the digital delay 5 of FIG. 2) of the digital counting device 40 has been completed, an electrical signal is transmitted for effecting the lift as just described, and at the same time a measurement comparison is made between voltages $U_1$ and $U_2$. The regulator 6 is thus in operation, and it adjusts the gap re-setting device 10 until the two values $U_1$ and $U_2$ entering the regulator 6 are equal to zero (voltage difference is equal to zero). The gap re-setting device 10 thus shifts the stop 11 which finally, on lowering of the cutter 23, determines the position in relation to the shear table and therefore the shear gap as such.

Considering the control sequence in more detail, on sensing of a seam by the sensor 4, a pulse generator 5*a* (FIG. 4) receiving a signal from sensor 4 via line 40*a* sets program I of the pre-programmed digital counter into operation by a signal thereto via line 40*b*. The follower roll 4*b*, on encountering a seam 3, initiates generation of a pulse by mechanical deflection of the lever 45 which is connected to the roll 4*b* and in turn the lever actuates the pin 4*a* of the sensor 4. Sensor 4 supplies the measured voltage to the regulator 6 of FIG. 5A. The limit switch 34 of FIG. 5A will then enable a connection to be made with the digital counter 40 of FIGS. 4 and 5B. Pulses from the transmitter 5A can then be supplied to the digital counter 40 and in particular to program I. When the seam has travelled over the arcuate value *b* to the seam 3*a* location, program I is completed. Three output signals are than effectively generated: the first signal, via line 40*c*, sets Program II into operation; the second signal is transmitted directly to the regulator 6 via line 40*e*, which carries out a comparison between the actual and required thickness values; and the third signal is transmitted to the relays of the hydraulic actuator 21 via line 40*d*, which enables the cutting tool to be raised by piston 22. After completion of the pre-programmed distance 2*a* energization of the actuator 21 brings the shearing tool back into its operational position. During this time, corresponding to the distance 2*a*, the automatic adjustment to the new nap height at the gap setting device 10 is effected in conformity with the regulator 6. The output signals of the regulator 6 are supplied through the limit switches 34, 35 to the circuit of the re-setting device motor 10.

It is a decisive factor that during the raising of the cutter 23, an automatic adjustment of the stop takes place, corresponding to the differences in thickness determined by the pieces of material 1 and 2. Thus, on replacing the cutter 23 on the newly adjusted stop 11, the shear gap is fixed for the altered thickness of the material 1.

When a seam 3 is reached, the control valve 21 receives an impulse from the control circuit, causing the cylinder 22 to raise the cutter arrangement 23 together with the blade 8, away from the shearing bar 7, about the fulcrum 20 of the lever system 19.

The cylinder 22 is so dimensioned that it is able to raise the cutter 23 together with the blade 8 a substantial distance from the bar 7, in opposition to the power of a setting cylinder 18, 18*a*. As this takes place, the piston of the setting cylinder 18, 18*a* is moved downwards, while the stop 11 moves to its terminal position and opens a path for the replacement flow of oil to the setting cylinder 18, 18*a*. The excess oil arising from the difference in cross-sectional area of the cylinder 18, 18*a* flows away through a safety valve 24. The lowering of the cutter arrangement 23 is carried out by the cylinder 18, 18*a*, the control valve 21 cutting off the flow of oil to the cylinder 22 and opening a path for the escaping oil.

Another embodiment will now be described in conjunction with FIG. 5. Here, instead of the hydraulic stop 11, a mechanical stop 12, is brought into use by a lifting cam 25, operated by the setting device 10.

As the seam 3 passes through, the cutter arrangement 23 is raised by the cylinder 22, compressed air being fed to the piston side of the cylinder 22 through a valve 26. The seam having passed, the cutter arrangement 23 is lowered again by switching over the valve 26.

To prevent unduly violent lowering into contact, damping cylinders 27 and 27*a* (only one shown) are fitted at the left and right hand side, respectively, on the front end of the lever 19. As the cutter arrangement 23 with the bottom blade 8 is lowered to give the requisite shearing gap, the damping cylinders 27 and 27*a* are thrust to their terminal position.

As the seam passes through, the depth of shear is adapted automatically to the new thickness of material. The thickness of the new run of material is measured by the thickness measuring sensor 4 and the shearing gap by the measurement value recorder 9. The shearinggap measurement is taken not directly from the cutter arrangement 23, but indirectly from the mechanical stop 12, to ensure the availability of a reliable measurement even when the cutter 23 is up, so that automatic re-setting may take place while the cutter 23 is raised. The mechanical stop 12 is displaced in the same manner, by the cam 25, as the fixed stop of the cutter 23 in the damping cylinders 27 and 27*a*, so that measurement at the stop 12 is equivalent to direct measurement of the gap between the bar 7 and the blade 8.

The cam 25 is now moved automatically until the shearing gap has been brought into line with the thickness of the material, that is to say until the measurement values of the two sensors 4 and 9 coincide.

Figure 6:
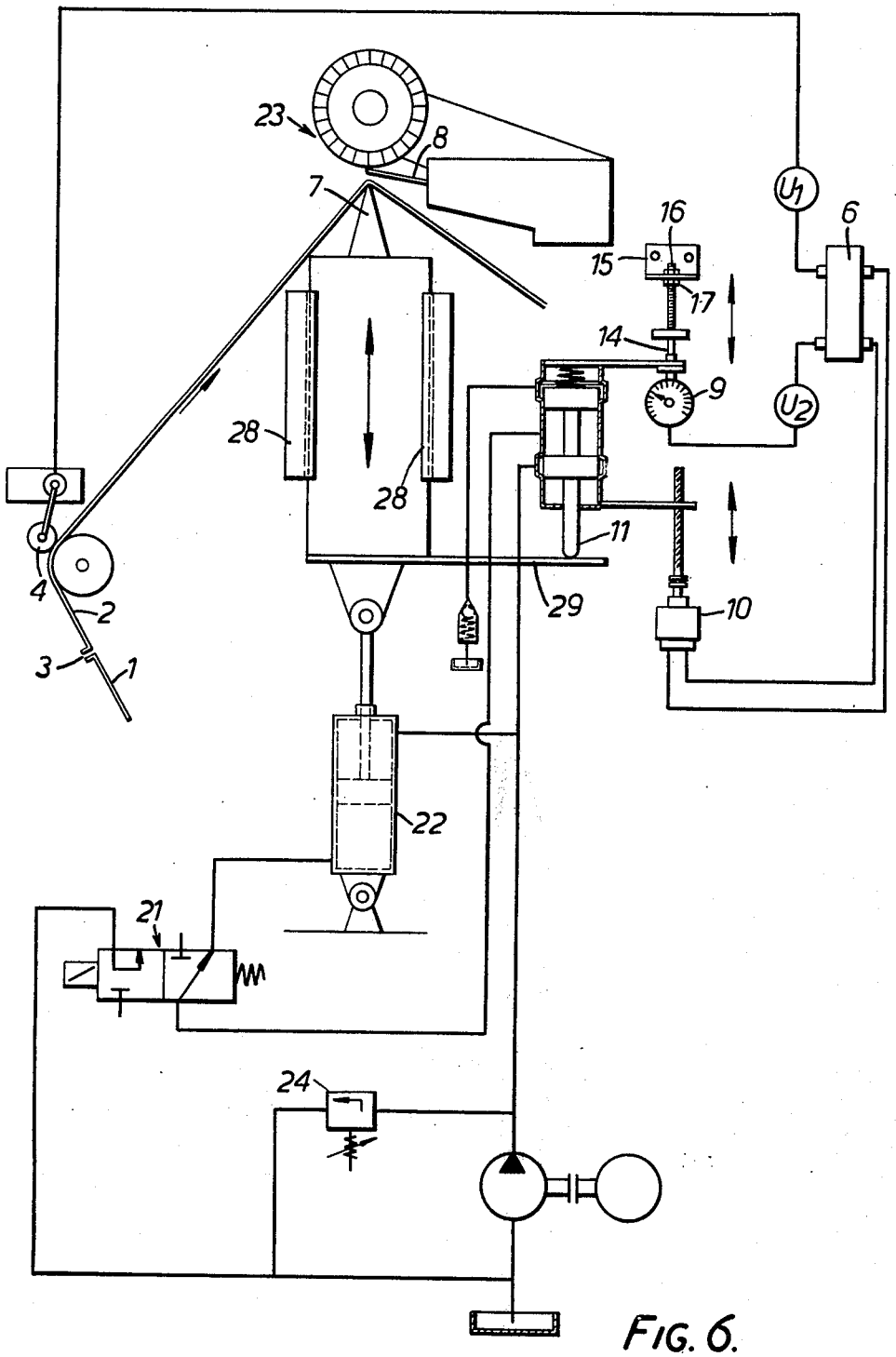
FIG. 6 shows an embodiment of an automatic control arrangement for the shearing gap including electro-hydraulic means, the shearing bar being lowered, together with the material from the fixed cutter arrangement, to afford free passage to the seam.

The embodiment of FIG. 6 is operable in the same way as that of the embodiment shown in FIG. 4.

Here, the cutter arrangement 23 together with the blade 8 is stationary, the bar 7 being lowered by a setting cylinder 22, as the seam moves past. The bar 7, mounted between two guide strips 28, has a stop engaging member 29, projecting sideways, which, as the bar 7 is re-set, comes up against the hydraulic stop 11, so as to limit the upward travel of the bar 7 by the setting cylinder 22.

As soon as a change in measurement value occurs at the thickness-measuring sensor 4, the re-setting drive 10 adjusts the hydraulic stop 11 until a measurement value of the same order occurs at the measured value recorder 9.

Figure 7:
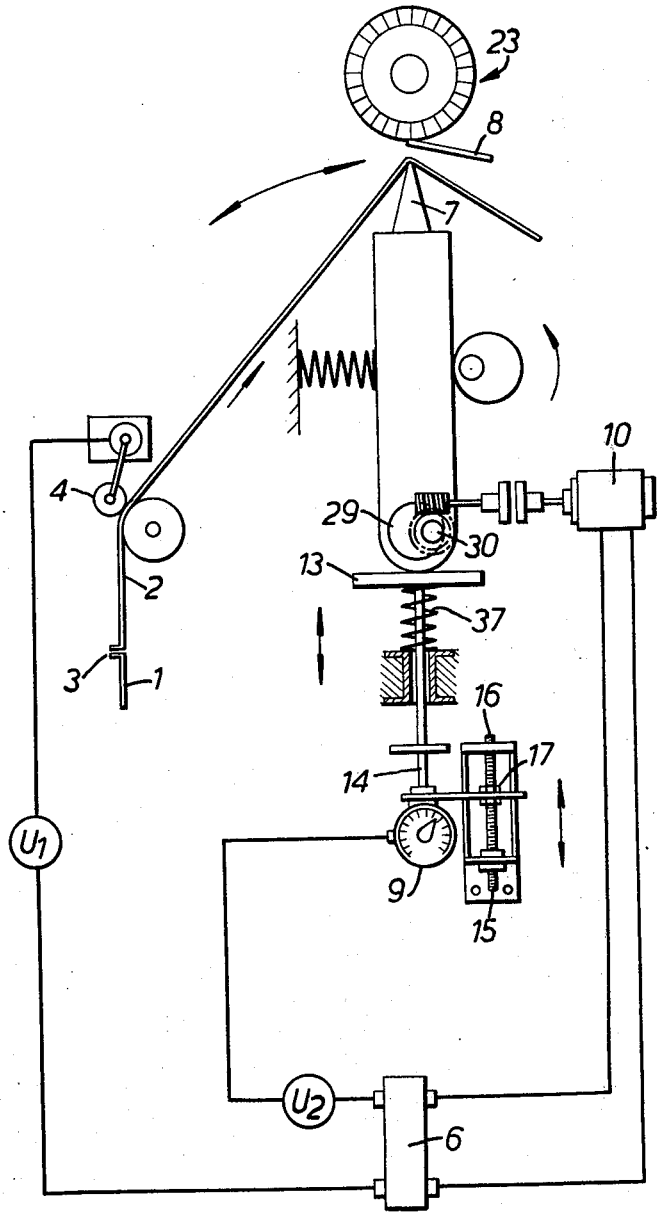
FIG. 7 shows an embodiment of an automatic control arrangement for the shearing gap including electro-mechanical means, the shearing bar being pivoted away from the cutter arrangement to afford free passage to the seam.

In the embodiment shown in FIG. 7, the shearing bar 7 can be swung away, about a pivot 29, from the cutting point of the cutter arrangement 23, to allow the seam 3 to pass.

Here, the pivot 29 of the bar 7 is mounted eccentrically, so that height correction can be applied to the bar 7 by movement of an eccentric spindle 30.

The rounded bottom end of the bar 7 bears on a mechanical stop system 13, which is fitted with a restoring spring 37, by which the measured value recorder 9 is finally affected.

With this regulating system, again, the re-setting device 10 moves the eccentric spindle 30 of the pivot 29 until the thickness and gap measurement values fed into the regulator 6 are in precise agreement.

A particular advantage of each of the described embodiments is that the desired shearing effect can be kept constant, irrespective of thickness variations in the pieces of material sewn together and, above all, without interrupting the work. If, for example, the thickness of the first piece of material 1, be designated $\delta_1$ and the desired depth of pile $h$, then, according to the invention, if the thickness of the material should change from $\delta_1$ to $\delta_2$, appropriate adjustment of the shearing gap will be made, so that the desired depth of pile $h$ and hence the same shearing effect will still be maintained with the thicker or thinner piece of material 2. The thickness change may thus be expressed as:

$$\frac{\delta_1 + h}{\delta_2 + h} \text{ or } \frac{\delta_2 + h}{\delta_1 + h}$$

If, for instance, it is desired to shear the material smooth, so that no fine hairs remain on the surface, the instruction to be given to the regulating device here proposed should be that the depth of pile must be nil. In that case, the thickness change will become:

$$\frac{\delta_1}{\delta_2} \quad \frac{\delta_2}{\delta_1}$$

The depth of pile having been prescribed as $H = 0$, the new device will enable all runs of material, irrespective of their thickness and above all with constant effect, to be shorn smooth.

We claim:

1. In a control arrangement incorporated in a shearing machine for shearing material having a base layer and a nap, cutter means, shearing bar means spaced by a gap from the cutter means and supporting the said material in nap cutting relationship with the cutter means, means carrying the shearing bar and cutter means for adjusting the gap between the bar means and the cutter means whereby the cut effected is varied, means for sensing continuously the thickness of the base layer and generating a signal having a value dependent upon that thickness, a measured value recorder for measuring the actual size of the shearing gap of the machine and for generating a signal having a value dependent upon that gap, regulating means connected to the sensing means and the measured value recorder whereby to receive both said signals and to generate a difference signal, and a re-set device connected to receive said difference signal and to vary the shearing gap of the machine by action on said carrying means until the difference signal reaches zero magnitude.

2. A control arrangement according to claim 1, comprising a delay unit interposed between the sensing means and the regulating means.

3. A control arrangement according to claim 2, wherein the delay unit comprises a digital counter operable independently of speed, and means for damping the sensing means during the delay period.

4. A control arrangement according to claim 1, wherein the carrying means comprises stop means actuable by the re-set device and fluid-actuated cylinders operable to adjust the gap between the bar means and the cutter means.

5. A control arrangement according to claim 4, wherein the stop means is in the form of an edge follower.

6. A control arrangement according to claim 1, wherein the carrying means comprises pivot means carrying the shearing bar, and the control arrangement further comprises an eccentric spindle carrying the pivot means, said re-set device including a stop and a spring biasing the stop, said stop serving to act upon the measured value recorder.

7. A control arrangement according to claim 6, comprising a sensor pin forming part of the measurement value recorder and said stop means acting upon the sensor pin.

8. A control arrangement according to claim 7, comprising a sensor spindle for adjusting the initial position of the setting pin.

* * * * *